United States Patent [19]

Imai et al.

[11] 4,145,901

[45] Mar. 27, 1979

[54] ROLLING MILL

[75] Inventors: Isao Imai, Yokohama; Hiroyuki Shiozaki, Yokosuka, both of Japan

[73] Assignee: Ishikawajima-Harima Jukogyo Kabushiki Kaisha, Tokyo, Japan

[21] Appl. No.: 880,932

[22] Filed: Feb. 24, 1978

[30] Foreign Application Priority Data

Feb. 28, 1977 [JP] Japan ..... 52-21343
May 27, 1977 [JP] Japan ..... 52-62667

[51] Int. Cl.[2] ..... B21B 37/00

[52] U.S. Cl. ..... 72/8; 72/17; 72/19; 72/205

[58] Field of Search ..... 72/199, 366, 205, 249, 72/8–12

[56] References Cited

U.S. PATENT DOCUMENTS 3,709,017 1/1973 Vydria et al. ..... 72/205
3,811,307 5/1974 Vydria et al. ..... 72/205

*Primary Examiner*—Milion S. Mehr
*Attorney, Agent, or Firm*—Scrivener, Parker, Scrivener & Clarke

[57] ABSTRACT

A rolling mill wherein a pair of upper and lower work rolls are rotated at different peripheral velocities with the peripheral velocity ratio being substantially equal to an elongation ratio at which a sheet metal is rolled, and the tensions exerted to the sheet metal entering and leaving the pair of work rolls are controlled in such a way that the velocity of the sheet metal entering the work rolls may be maintained equal to the peripheral velocity of one of the pair of work rolls which is rotated slower than the other while the velocity of said sheet metal leaving the work rolls may be maintained equal to the peripheral velocity of said the other work roll. Rolling may be accomplished without the need of wrapping the sheet metal around the work rolls, and the rolling pressure may be reduced to a degree comparable RD process.

5 Claims, 7 Drawing Figures

ROLLING MILL

DETAILED DESCRIPTION OF THE INVENTION

The present invention relates to a rolling mill.

In rolling metal into sheets, the reduction in rolling load is essential for the reduction in size of rolling mills, wear of rolls and edge drop and for the reduction of hard materials especially those having a greater width.

As shown in FIG. 1, in general, the reduction of metal into a sheet c is accomplished by a pair of upper and lower work rolls a and b which have the same diameter and are rotated at the same peripheral velocity. Since the surface speeds of these rollers a and b are same, the neutral points $N_1$ and $N_2$ where the metal moves at the same velocity as the surface of the work rolls are on the same vertical line. The roll bite portion or zone indicated by the hatched area, the frictional forces which are directed as indicated by the arrows pull the metal into the work rolls so that it is subjected to the horizontal compression and the vertical reduction load or pressure becomes higher than when there is no frictional force.

In a rolling mill shown in FIG. 2, the peripheral velocities of the upper and lower word rolls a and b are different. For instance, the lower work roll b is rotated at a peripheral velocity $V_0$ which is slower than the peripheral velocity $V_1$ of the upper work roll a. Furthermore in rolling the following relationship is maintained:

$$V_1/V_0 < h_0/h_1$$

where $h_0$ = the thickness of the metal entering the work rolls; and $h_1$ = the thickness of the metal leaving the work rolls.

Under these conditions, the lower and upper neutral points $N_1$ and $N_2$ are offset from each other and are located on the arcs of contact so that the frictional forces between the lower work roll b and the metal are directed opposite to the frictional forces between the upper work roll a and the metal as indicated by the arrows. As a result, there exists a zone c' which is not subjected to the horizontal compression. Though ahead and after this zone c' the rolling conditions are similar to those of the rolling mill shown in FIG. 1, the rolling load may be considerably reduced as compared with the rolling mill shown in FIG. 1.

According to the currently developed rolling drawing process to be referred to RD process, the rolling load may be considerably reduced so that the above described objects may be attained. That is, the RD process is carried out under the following conditions:

$$V_1/V_0 = h_0/h_1 \text{ and } V_1 > V_0$$

where $V_1$ = the velocity of the work roll a and the velocity $v_1$ of the metal leaving the work rolls, $V_0$ = the velocity of the work roll b and the velocity $v_0$ of the metal entering the work rolls, $h_0$ = the thickness of the metal entering the work rolls, and $h_1$ = the thickness of the metal leaving the work rolls.

Under these conditions the neutral points $N_1$ and $N_2$ are further offset from each other and coincide with the entering and exit points, respectively. The upper and lower frictional forces are opposite in direction so that the metal is not subjected to the horizontal compression at all and the rolling load is independent of the frictional forces and is considerably reduced, whereby the above described objects may be attained.

However RD process has a problem that it is extremely difficult to make the neutral points $N_1$ and $N_2$ always coincident with the entering or biting and exit points, respectively. To overcome this problem, as shown in FIG. 4, the metal c is partly wrapped around both the upper and lower work rolls a and b at a suitable subtended or wrapping angle $\theta$ so that the conditions of $$v_0 = V_0 \text{ and } v_1 = V_1$$

may be satisfied by the use of the frictional forces between the upper and lower work rolls a and b.

When the metal c is wrapped around the upper and lower work rolls of a two-high rolling mill and it is assumed that the tension $t_0$ at the entering point to the mill and the tension $t_1$ at the exit point from the mill be maintained constant, the tension $t_b$ at the bite point to the roll bite zone x and the tension $t_f$ at the point leaving the zone x may be variable within the following ranges:

$$t_0 e^{-\mu\theta} \leqq t_b \leqq t_0 e\mu\theta$$

$$t_1 e^{-\mu\theta} \leqq t_f \leqq t_1 e\mu\theta$$

where $\mu$ = coefficient of friction between the work roll a, b and metal c, and e = the base of natural logarithms.

Therefore the automatic thickness adjustment by tension may be accomplished against the roll eccentricity and other external disturbances so that the stable rolling may be ensured. Furthermore the above described condition $$V_1/V_0 = h_0/h_1$$

is also satisfied so that the upper and lower frictional forces are opposite in direction. As a result, rolling load is independent of the frictional forces and is considerably reduced.

Since metal must be wrapped around the work rolls, RD process has the following problems:

(1) It is difficult to pass a metal sheet through rolling mills;

(2) Rapid roll wear results;

(3) The surfaces of the sheet metal are damaged;

(4) With a tandem rolling mill of the type shown in FIG. 5, no backing roll can be provided so that the bending of work rolls tends to result and the control of rolling pressure is extremely difficult.

One of the objects of the present invention is therefore to provide a rolling mill capable of rolling a sheet metal into a final product under the rolling pressure reduced to a degree comparable to the rolling pressure used in RD process without the need of wrapping the metal sheet around the work rolls.

Another object of the present invention is to provide a rolling mill capable of continuous rolling.

A further object of the present invention is to provide a rolling mill wherein the correct relationship between the peripheral velocity ratio between the upper and lower work rolls and the ratio between the velocity of the sheet metal entering the work rolls and the velocity of the sheet metal leaving the work rolls may be maintained.

The present invention will become apparent from the following description of preferred embodiments thereof taken in conjunction with the accompanying drawings, in which.

Figure 6:
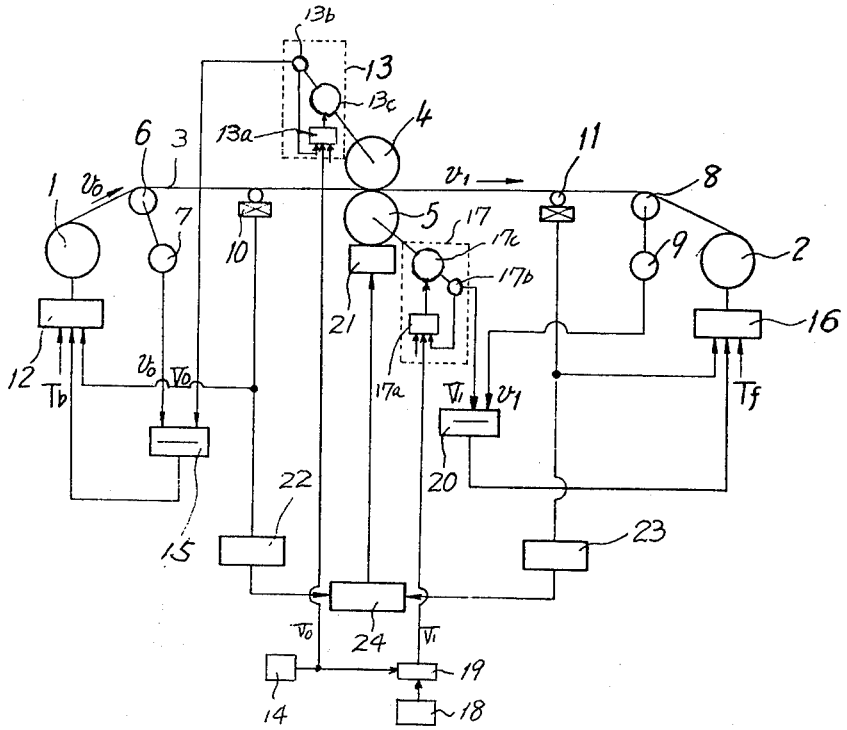
FIG. 6 is a diagrammatic view of a first embodiment of the present invention.

First Embodiment, FIG. 6

Referring to FIG. 6, a sheet metal 3 is uncoiled from an uncoiler 1, passes a deflector roll 6, is rolled by a pair of upper and lower rolls 4 and 5, passes a deflector roll 8 and is again coiled by a coiler 2.

The velocity $v_0$ of the metal sheet 3 entering the work rolls 4 and 5 is detected by an inlet sheet metal velocity detector 7 operatively coupled to the deflector roll 6 and is applied to a first velocity comparator 15. In like manner the velocity $v_1$ of the sheet metal 3 leaving the work rolls 4 and 5 is detected by an outlet sheet metal velocity detector 9 operatively coupled to the deflector roll 8 and is applied to a second velocity comparator 20.

The tension of the metal sheet 3 entering the work rolls 4 and 5 is detected by an inlet or upstream tension gage 10 and is applied to an uncoiler tension control unit 12 and to a first tension limiter 22. In like manner the tension of the sheet 3 leaving the work rolls 4 and 5 is detected by an outlet or downstream tension gage 11 and is applied to a recoiler tension control unit 16 on the outlet side and to a second tension limiter 23.

An upper work roll velocity regulation unit 13 which controls the surface speed $V_0$ of the upper work roll 4 includes an upper work roll velocity control unit 13*a*, an upper work roll velocity sensor 13*b* and a motor 13*c*. In response to the output signal from the velocity detector 13*b* respresentative of the peripheral velocity $V_0$ of the upper work roll 4 and the present velocity signal from a velocity set unit 14, the velocity control unit 13*a* controls the motor 13*c*, thereby controlling and maintaining the velocity of the upper work roll 4 at the predetermined velocity $V_0$. In like manner, a lower work roll velocity regulation unit 17 which controls the velocity of the lower work roll 5 includes a lower work roll velocity control unit 17*a*, a lower work roll velocity detector 17*b* and a motor 17*c*. In response to the output signal from the velocity detector 17*b* and the output signal or the velocity signal from a multiplier 19 to be described hereinafter, the velocity control unit 17*a* controls the motor 17*c* so that the lower work roll 5 is rotated at the predetermined velocity $V_1$. The multiplier 19 multiplies the velocity signal from the upper work roll velocity set unit 14 and the output representing a predetermined elongation ratio ($h_0/h_1$) received from an elongation ratio set unit 18 and transmits the product signal or the velocity signal ($V_1 = V_0 X h_0/h_1$) to the velocity control unit 17*a*.

The output signal from the velocity detector 13*b* is also applied to a velocity comparator 15 and is compared with the sheet metal velocity signal from the velocity detector 7. When there is a difference between these two velocity signals, the velocity comparator 15 generates a difference signal or a tension control signal. In response to a preset tension signal $T_b$ from a tension preset unit (not shown) and the output signal from the inlet tension gage 10, and additionally in response to the tension correction signal from the velocity comparator 15, the first tension control unit 12 maintains the predetermined tension and corrects the tension of the sheet metal 3 in such a way that the sheet metal velocity $v_0$ may be maintained equal to the peripheral velocity $V_0$ of the upper work roll 4.

In like manner the output signal from the lower work roll velocity detector 17*b* is applied to the velocity comparator 20 and is compared with the sheet metal velocity signal from the outlet velocity detector 9, and when there is a difference between these two velocity signals the velocity comparator 20 generates a difference signal or a tension correction signal. In response to the preset tension signal $T_f$ from a tension preset unit (not shown) and the tension signal from the downstream tension gage 11 and additionally in response to the tension correction signal from the velocity comparator 20 the second tension control unit 16 maintains the predetermined tension and corrects the tension of the sheet metal 3 leaving the work rolls 4 and 5 in such a way that the velocity $v_1$ of the sheet metal 3 may be always maintained equal to the peripheral velocity $V_1$ of the lower work roll 5.

When the tensions of the sheet metal 3 entering and leaving the work rolls 4 and 5 detected by the upstream and downstream tension gages 10 and 11 exceed predetermined levels, the first and second tension limiters 22 and 23 generate signals which in turn are applied to an arithmetic and logic circuit 24. In response to the output signals from the tension limiters 22 and 23, the arithmetic and logic circuit 24 generates a reduction control or correction signal which in turn is transmitted to a reduction unit 21. In response to the reduction correction signal from the arithmetic and logic unit 24 the reduction unit 21 corrects the gap or space between the upper and lower work rolls 4 and 5.

Figure 1:
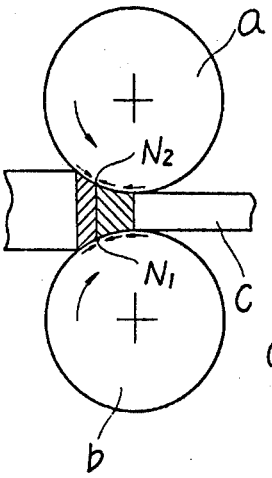
PRIOR ART Fig. 1
FIG. 1 is a schematic view of a prior art rolling mill wherein a pair of work rolls have the same diameter and are rotated at the same peripheral velocity.
Figure 2:
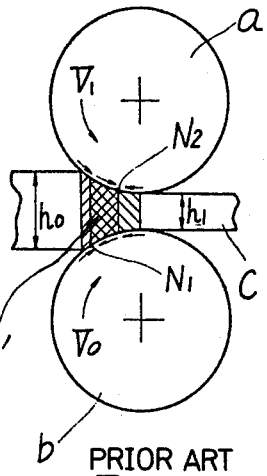
PRIOR ART Fig. 2
FIG. 2 is a schematic view of a prior art rolling mill wherein a pair of work rolls are rotated at different peripheral velocities.
Figure 3:
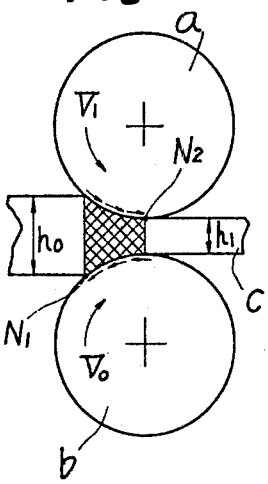
PRIOR ART Fig. 3
FIG. 3 is a schematic view used for the explanation of RD process.
Figure 4:
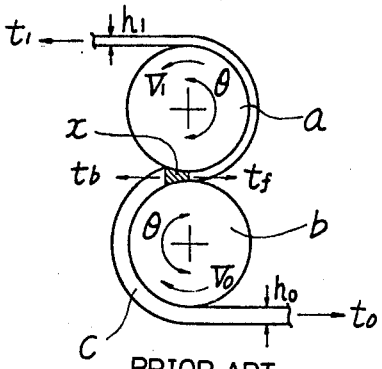
PRIOR ART Fig. 4
FIG. 4 is a schematic view of a RD process wherein a sheet metal is wrapped partly around the work rolls.
Figure 5:
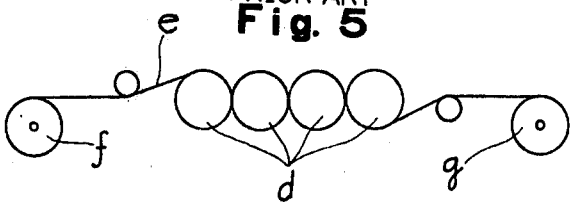
PRIOR ART Fig. 5
FIG. 5 shows schematically a RD process with a tandem rolling mill.

Next the mode of operation of the rolling mill with the above construction will be described. Rolling must be carried out under the conditions that the ratio of the peripheral velocity of one of a pair of work rolls which is rotated faster than the other work roll to the peripheral velocity of the other roll must be always maintained equal to the elongation ratio of the thickness of the sheet metal entering the work rolls to the thickness of the sheet metal leaving the work rolls and that the velocity of the sheet metal entering the work rolls must be maintained equal to the peripheral velocity of the other work roll (which is rotated slower than one work roll) while the velocity of the sheet metal leaving the work rolls must be maintained equal to the peripheral velocity of said one work roll, whereby the neutral point between the sheet metal and the other work roll may be located at the entering or bite point while the neutral point between the sheet metal and one work roll may be located at the exit point as described with reference to FIG. 3. That is, $$V_1/V_0 = v_1/v_0 = h_0/h_1 = \lambda$$

$$V_1 = v_1,$$

$$V_0 = v_0, \text{ and}$$

$$V_1 > V_0$$

where $V_1$ = the peripheral velocity of the lower work roll 5;

$V_0$ = the peripheral velocity of the upper work roll 4;

$v_1$ = the velocity of the sheet metal 3 leaving the work rolls;

$v_0$ = the velocity of the sheet metal 3 entering the work rolls;

$h_0$ = the thickness of the sheet metal 3 entering the work rolls;

$h_1$ = the thickness of the sheet metal 3 leaving the work rolls; and $\lambda$ = elongation ratio.

Therefore the velocity $v_0$ of the sheet metal 3 uncoiled from the uncoiler 1 and entering the work rolls 4 and 5 is detected by the inlet velocity detector 7, and in response to this detected velocity the tension of the sheet metal 3 entering the work rolls 4 and 5 is so controlled that the velocity $v_0$ of the sheet metal may be always maintained equal to the peripheral velocity $V_0$ of the upper work roll 4. In like manner, the velocity $v_1$ of the sheet metal 3 leaving the work rolls 4 and 5 and being coiled by the coiler 2 is detected by the downstream velocity detector 9, and in response to this detected velocity the tension exerted to the sheet metal leaving the work rolls 4 and 5 is so controlled that the velocity $v_1$ of the sheet metal 3 may be always equal to the peripheral velocity $V_1$ of the lower work roll 5.

When the excessive tensions are exerted to the sheet metal, the gap or space between the upper and lower work rolls 4 and 5 is corrected by the reduction unit 21.

More particularly, the first tension control unit 12 is responsive to the preset tension signal $T_b$ and the output signal from the upstream tension gage 10 so as to normally maintain at constant the tension of the sheet metal 3 entering the work rolls 4 and 5. In like manner, in response to the preset tension signal $T_f$ and the output signal from the downstream tension gage 11, the second tension control unit 16 controls and maintains at constant the tension exerted from the uncoiler 2 to the sheet metal 3 leaving the work rolls 4 and 5. That is, the tension control units 12 and 16, the uncoiler 1 and recoiler 2 and the upstream and downstream tension gages 10 and 11 constitute closed feedback systems, whereby the predetermined tensions may be exerted to the metal sheet 3 entering and leaving the work rolls 4 and 5, and consequently the sheet metal 3 may enter and leave the work rolls 4 and 5 at the predetermined velocities $v_0$ and $v_1$, respectively.

Meanwhile the upper work roll is maintained at $V_0$ by the upper work roll velocity regulation unit 13 while the lower work roll 5 is maintained at $V_1$ by the lower work roll velocity regulation unit 17. In order to satisfy the rolling conditions described above, the velocity $v_0$ of the sheet metal entering the work rolls is detected by the first or upstream velocity detector 7 and is compared with the velocity $V_0$ of the upper work roll 4 by the first velocity comparator 15. When the detected velocities $V_0$ and $v_0$ are different the first velocity comparator 15 generates a difference signal or a tension correction signal. In response to this tension correction signal, the tension control unit 12 controls the uncoiler 1 so that the velocity of the sheet metal 3 entering the work rolls 4 and 5 may be equal to the velocity $V_0$ of the upper work roll. In like manner, the velocity $v_1$ of the sheet metal 3 leaving the work rolls 4 and 5 is detected by the downstream velocity detector 9 and is compared with the velocity $V_1$ of the lower work roll 5 by the second velocity comparator 20. When the detected velocities $V_1$ and $v_1$ are different from each other, the second comparator 20 generates a difference signal or a tension correction signal which in turn is transmitted to the second tension control unit 16. In response to this tension correction signal the second tension control unit 16 controls the coiler 2 so that the velocity $v_1$ of the sheet metal 3 leaving the work rolls 4 and 5 may be equal to the peripheral velocity $V_1$ of the lower work roll 5. Thus the rolling conditions $V_0 = v_0$ and $V_1 = v_1$ may be always satisfied, whereby the sheet metal 3 may be rolled into a final product having excellent surface qualities and correctly controlled dimensions.

The first embodiment descibed above may be improved or modified as will be described below. That is, the reduction unit 21 maintains a predetermined rolling pressure or a space between the upper and lower work rolls 4 and 5, but when the space or the rolling pressure varies, the tensions of the sheet metal 3 vary so that entering and leaving velocities $v_0$ and $v_1$ of the sheet metal 3 vary accordingly. Therefore the rolling pressure or the space between the upper and lower rolls 4 and 5 must be corrected from time to time. To this end, the upstream and downstream tension gages 10 and 11 always monitor the tensions exerted to the metal sheet 3 entering and leaving the work rolls 4 and 5 so that the detected tensions may be fed back to the first and second tension control units 12 and 16 in the manner described above. When the tensions detected by the upstream and downstream tension gages 10 and 11 exceed the predetermined levels due to the errors in setting the upper and lower work rolls 4 and 5 and/or the variation in thickness of the entering and leaving sheet metal 3, the tension limiters 22 and 23 generate the signals which in turn are transmitted to the arithmetic and logic circuit 24 which converts the output signal from the tension limiter 22 or 23 into the signal representing the excessive tension in terms of a rolling pressure or a space between the upper and lower work rolls 4 and 5. In response to this reduction correction signal from the arithmetic and logic circuit 24, the reduction unit 21 corrects the rolling pressure or the space between the upper and lower work rolls 4 and 5, thereby correcting the tensions exerted to the sheet metal. Thus the rolling conditions described above may be satisfied.

So far the first embodiment of the present invention has been described as passing the sheet metal 3 from the uncoiler 1 to the recoiler 2, but it will be understood that the rolling direction may be reversed from the recoiler 2 to the uncoiler 1 without any change in setting. In this case, the above described rolling conditions may be equally completely satisfied. Furthermore, a plurality of rolling stands may be used.

Figure 7:
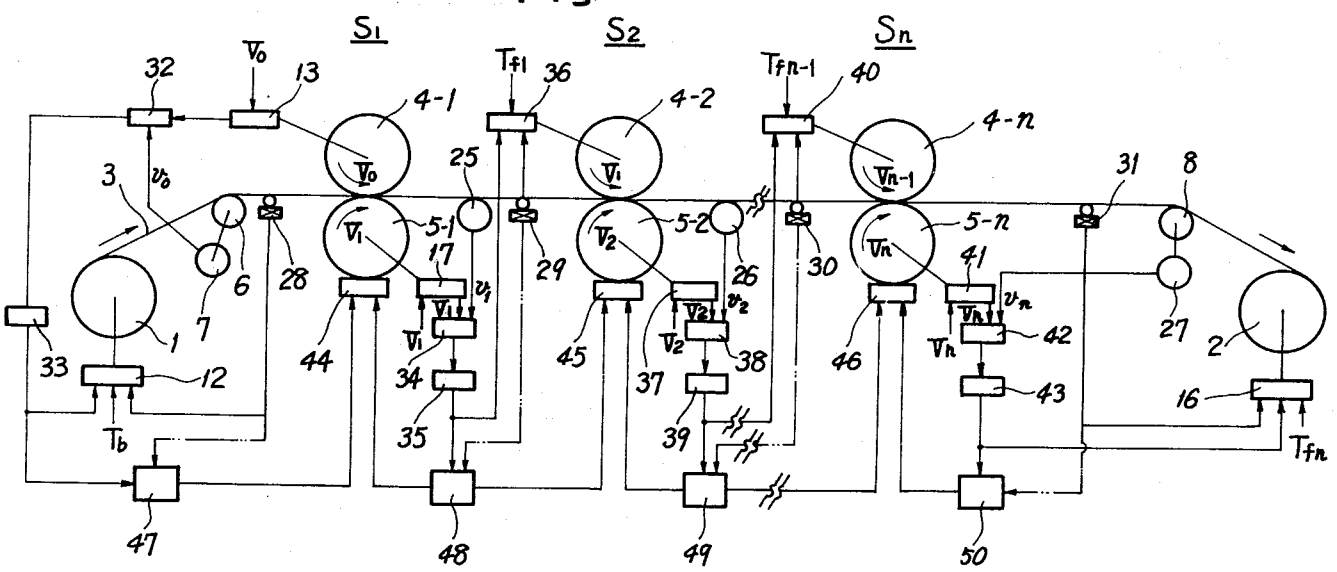
FIG. 7 is a schematic view of a second embodiment of the present invention.

Second Embodiment, FIG. 7

Next referring to FIG. 7, the second embodiment or a continuous rolling mill in accordance with the present invention will be described. The sheet metal 3 which is uncoiled from the uncoiler 1 passes the deflector roll 6, a first stand $S_1$ having a pair of upper and lower work rolls 4-1 and 5-1, a second stand $S_2$ having a pair of upper and lower work rolls 4-2 and 5-2 and a last stand $S_n$ having a pair of upper and lower work rolls 4-n and 5-n and the deflector roll 8 and is coiled again by the recoiler 2. As with the first embodiment described above, rolling conditions are such that at each stand $S_n$ the upper and lower work rolls 4-n and 5-n are rotated at different peripheral velocities $V_{n-1}$ and $V_n$; the velocity $v_{n-1}$ of the sheet metal entering the work rolls 4-n and 5-n must be equal to the peripheral velocity of the upper work roll 4-n which is rotated slower than the lower work roll 5-n while the velocity $v_n$ of the sheet metal leaving the work rolls 4-n and 5-n must be equal to the peripheral velocity $V_n$ of the lower work roll 5-n; and that when there occurs any difference between the velocity of the metal sheet entering the work rolls and the upper work roll and between the velocity of the sheet metal leaving the work rolls and the lower roll, the difference in velocity must be eliminated immediately.

The velocity detector 7, the uncoiler tension control unit 12, the upper work roll velocity regulation unit 13, the recoiler tension control unit 16 and the lower work roll velocity regulation unit 17 in the first stand $S_1$ are substantially similar in both construction and operation to those in the first embodiment described with reference to FIG. 6. Velocity detectors 25, 26 and 27 are disposed at the downstream of the stand $S_1$, $S_2$ and $S_n$ for detecting the velocities $v_1$, $v_2$ and $v_n$ of the sheet metal 3 leaving the work rolls in the respective stands. Tension gages 28, 29 and 30 are disposed at the upstream of the work rolls in the respective stand $S_1$, $S_2$ and $S_n$ for detecting the tensions of the sheet metal 3 entering the work rolls, and a tension gage 31 is disposed at the downstream of the work rolls 4-n and 5-n in the last stand $S_n$ for detecting the tension of the sheet metal 3 leaving the work rolls.

The output signal representative of the peripheral velocity $V_0$ of the upper work roll 4-1 from the upper work roll velocity regulation unit 13 and the output signal representative of the velocity $v_0$ of the sheet metal entering the work rolls 4-1 and 5-1 from the velocity detector 7 are applied to a velocity comparator 32. When there is a difference between these output signals, the comparator 32 generates a velocity difference signal which is transmitted to a converter 33. The converter 33 converts the velocity difference signal received into the signal representing the velocity difference in terms of a tension difference, and the tension difference signal or the tension correction signal is applied to the uncoiler tension control unit 12 which in turns corrects the tension in the manner described in the first embodiment.

The output signal representative of the peripheral velocity $V_1$ of the lower work roll 5-1 in the first stand $S_1$ from the lower work roll velocity regulation unit 17 is applied to a velocity comparator 34 and is compared with the output signal from the velocity detector 25 representing the velocity $v_1$ of the sheet metal 3 leaving from the first stand $S_1$ and entering the second stand $S_2$. When there is a difference between these output signals, the comparator 34 generates a velocity difference signal which in turn is transmitted to a converter 35 which in turn converts the velocity difference signal received into the signal representing the velocity difference in terms of a tension difference. This tension difference signal or the tension correction signal is applied to a tension control unit 36. In response to the tension correction signal from the converter 35, the tension signal from the tension gage 29 and the preset tension signal $T_{f1}$, the tension control unit 36 controls the peripheral velocity of the upper work roll 4-2 in the second stand $S_2$ in such a way that the tension exerted to the metal sheet 3 between the stands $S_1$ and $S_2$ may be maintained at a predetermined level.

The peripheral velocity $V_2$ of the lower work roll 5-2 in the second stand $S_2$ is controlled by a lower work roll velocity regulation unit 37 similar in construction and operation to the lower work roll velocity regulation unit 17. The output representative of the peripheral velocity $V_2$ of the lower work roll 5-2 from the lower work roll velocity regulation unit 37 and the output signal representative of the velocity $v_2$ of the sheet metal leaving the second stand $S_2$ and entering the next stand from the sheet metal velocity detector 26 are applied to a velocity comparator 38 which compares these velocity signals. When there is a difference between those outputs, the comparator 38 generates a velocity difference signal which is transmitted to a converter 39. The converter 39 converts the velocity difference signal into the signal representing the velocity difference in terms of a tension difference, and this tension difference signal or the tension correction signal is transmitted to a tension control unit in the next stand which is similar in construction and operation to the tension control unit 36 in the second stand $S_2$.

A tension control unit 40 in the last stand $S_n$ is substantially similar in construction and mode of operation to the tension control unit 36 in the second stand $S_2$. That is, in response to the preset tension signal $T_{fn-1}$, the tension signal from the tension gage 30 and the tension correction signal from the preceding stand, the tension control unit 40 maintains the velocity of the upper work roll 4-n at a predetermined peripheral velocity $V_{n-1}$ and corrects the velocity $V_{n-1}$ so that the peripheral velocity $V_{n-1}$ may be always maintained equal to the velocity $v_{n-1}$ of the metal sheet 3 entering the last station $S_n$.

A lower work roll velocity regulation unit 41, a velocity comparator 42 and a converter 43 are substantially similar in construction and mode of operation to those 17, 34 and 35 in the first stand $S_1$ except that the output signal or the tension correction signal from the converter 43 is applied to the uncoiler tension control unit 16.

With the second embodiment, rolling conditions are substantially similar to those in the first embodiment. That is, at the first stand $S_1$ $$v_1/v_0 = V_1/V_0 = h_0/h_1 = \lambda_1$$

$$v_1 = V_1,$$

$$v_0 = V_0, \text{ and}$$

$$V_1 > V_0$$

at the second stand, $$v_2/v_1 = V_2/V_1 = h_1/h_2 = \lambda_2$$

$$v_2 = V_2,$$

$$v_1 = V_1, \text{ and}$$

$$V_2 > V_1$$

and at the i-th stand, $$v_i/v_{i-1} = V_i/V_{i-1} = h_i/h_{i-1} = \lambda_i$$

$$v_i = V_i,$$

$$v_{i-1} = V_{i-1}, \text{ and}$$

$$V_i > V_{i-1}$$

where i = 1, 2, 3, . . .,n;

$v_i$ = the velocity of the sheet metal 3 leaving the i-th stand;

$v_{i-1}$ = the velocity of the sheet metal entering the i-th stand;

$V_i$ = the peripheral velocity of the lower work roll 5-i;

$V_{i-1}$ = the peripheral velocity of the upper work roll 4-i;

$h_i$ = the thickness of the sheet metal leaving the i-th stand;

$h_{i-1}$ = the thickness of the sheet metal entering the i-th stand; and $\lambda_i$ = the elongation ratio.

In order to satisfy the above rolling conditions, at each stand the differences between the velocity $v_{i-1}$ of the sheet metal 3 entering the i-th stand and the peripheral velocity $V_{i-1}$ of the upper work roll 4-i and between the velocity $v_i$ of the sheet metal leaving the i-th stand and the peripheral velocity $V_i$ of the lower work roll 5-i are detected, and in response to the velocity difference signals the tensions exerted to the sheet metal are corrected so that the velocity difference becomes zero (or the above conditions may be satisfied), whereby the upper and lower neutral points may be located at the bite and exit points as in the case of RD process.

More particularly, the velocity $v_0$ of the metal sheet 3 entering the first stand $S_1$ is detected by the velocity detector 7 and is compared with the velocity $V_0$ of the upper work roll 4-1 in the velocity comparator 32. When there is a difference between these velocities, the comparator 32 generates the velocity difference signal which is applied to the converter 33 and is converted into the signal representing the velocity difference in terms of a tension difference. This tension correction signal is applied to the tension control unit 12 which in turn controls the tension exerted from the uncoiler 1 to the sheet metal 3 in such a way that the velocity $v_0$ of the sheet metal 3 may be equal to the peripheral velocity $V_0$ of the upper work roll 4-1 in the first stand $S_1$ (that is, there may be no difference between the velocity $v_0$ and the peripheral velocity $V_0$ of the work roll 4-1).

The uncoiler tension control unit 12 is also responsive to the preset tension signal $T_b$ and the tension signal fed back from the tension gage 28 so that the tension of the sheet metal may be maintained at predetermined level. In response to the tension control signal from the converter 33 the tension control unit 12 increases or decreases this predetermined tension in such a way that the velocity $v_0$ of the sheet metal 3 entering the first stand $S_1$ may be equal to the peripheral velocity $V_0$ of the upper work roll 4-1. Therefore, as described above, the neutral point $N_1$ is coincident with the bite or entering point as in the case of RD process.

The velocity of the lower work roll 5-1 which is rotated faster than the upper work roll 4-1 is maintained at the predetermined velocity $V_1$ by the lower work roll velocity regulation unit 17. The velocity $v_1$ of the sheet metal 3 leaving the first stand $S_1$ and entering the second stand $S_2$ is detected by the velocity detector 25 and is compared in the velocity comparator 34 with the velocity $V_1$ of the lower work roll 5-1. When there is a difference between these velocities, the velocity comparator 34 generates the velocity difference signal which is transmitted to the converter 35 which in turn converts the velocity difference signal into the tension difference signal. The tension difference signal or the tension correction signal is applied to the tension control unit 36. In response to the preset tension signal $T_{f1}$ and the tension signal fed back from the tension gage 29 the tension control unit 36 controls the peripheral velocity of the upper work roll 4-2 in such a way that the tension exerted to the sheet metal between the first and second stands $S_1$ and $S_2$ may be normally maintained at a predetermined tension. But in the case where the tension difference or correction signal is fed from the converter 35, the tension control unit 36 increases or decreases the tension above or below the predetermined tension so that the velocity $v_1$ of the sheet metal 3 leaving the first stand $S_1$ and entering the second stand $S_2$ may be equal to the peripheral velocity $V_1$ of the lower work roll 5-1 in the first stand $S_1$, whereby the neutral point $N_2$ may be in coincidence with the exit point as in the case of RD process. Meanwhile the velocity $v_1$ of the sheet metal 3 entering the second stand $S_2$ is maintained equal to the peripheral velocity $V_1$ of the upper work roll 4-2 in the second stand $S_2$.

In like manner, in the respective stands the above rolling conditions are maintained. In the last stand $S_n$ the lower work roll velocity signal from the lower roll velocity regulation unit 41 and the sheet metal velocity signal from the velocity detector 27 are compared by the velocity comparator 42, and when there is a difference between these signals, the comparator 42 generates the velocity difference signal which is transmitted to the converter 43 which in turn converts the velocity difference signal into the tension signal which is transmitted to the recoiler tension control unit 16. In response to this signal the control unit 16 increases or decreases the tension exerted to the sheet metal leaving the stand $S_n$ above or below the predetermined tension so that the velocity $v_n$ of the metal sheet leaving the stand $S_n$ may be maintained equal to the peripheral velocity $V_n$ of the lower work roll 5-n in the stand $S_n$.

As described above, according to the present invention, the tensions exerted to the sheet metal are so controlled that the velocity of the sheet metal entering the work rolls may be maintained equal to the peripheral velocity of one of the pair of work rolls which is rotated slower than the other while the velocity of the sheet metal leaving the work rolls may be maintained equal to the velocity of the other work roll and to the peripheral velocity of one work roll in the next stand which is rotated slower than the other. Therefore the neutral point $N_1$ between the sheet metal and said one work roll which is rotated slower than the other work roll is made into coincidence with the entering or bite point while the neutral point $N_2$ between the sheet metal and the other work roll which is rotated faster than said one work roll is made into coincidence with the exit point as with the case of RD process. Therefore the continuous rolling may be carried out under the rolling conditions substantially similar to those of the RD process.

Next still referring to FIG. 7 a modification or an improvement of the second embodiment will be described. The output or the tension correction signal from the converter 33 is applied to a tension limiter 47 which is operatively connected to a reduction unit 44 in the first stand $S_1$. In like manner the tension correction signal from the converter 35 in the second stand $S_2$ is applied to a tension limiter 48 the output of which is applied to both the reduction units 44 and 45 in the first and second stands $S_1$ and $S_2$. The tension correction signal from the converter 39 is applied to a tension limiter 49 the output of which is applied to the reduction unit 45 and the reduction unit in the next stand. The output or the tension correction signal from the converter 43 in the last stand $S_n$ is applied to a tension limiter 50 the output of which is applied to a reduction unit 46 in the last stand $S_n$ to which is also applied the output from a tension limiter in the preceding stand.

These tension limiters 47, 48, 49 and 50 generate the reduction correction signals when the inputs to them exceed predetermined tension level, and in response to such reduction correction signal the reduction unit 44, 45 or 46 corrects the space between the work rolls 4 and 5.

More particularly, when the uncoiler 1 exerts excessive tension to the sheet metal, the tension correction signal or the tension signal applied to the tension limiter 47 exceeds a limit set in the tension limiter 47 so that the latter generates the reduction correction signal which is applied to the reduction unit 44. In response to this signal the reduction unit 44 corrects the space between the upper and lower work rolls 4-1 and 5-1 so that the tension exerted to the sheet metal between the uncoiler 1 and the first stand $S_1$ may be maintained below a predetermined upper limit. Because of this tension correction, the difference between the sheet metal velocity and the upper roll velocity may be eliminated. In like manner, when the tension correction signal from the converter 35 in the first stand $S_1$ exceeds a preset upper limit, the tension limiter 48 generates the reduction correction signal which is applied to the reduction units 44 and 45 in the first and second stands $S_1$ and $S_2$. In response to this reduction correction signal the reduction units 44 and 45 correct the space between the upper and lower work rolls 4-1 and 5-1 and the space between the upper and lower rolls 4-2 and 5-2 so that the tension exerted to the sheet metal between the first and second stands $S_1$ and $S_2$ may be maintained below a predetermined upper limit.

When excessive tension is exerted to the sheet metal 3 leaving the stand $S_n$ in the control for eliminating the difference in velocity between the sheet metal 3 and the lower work roll 5-n, the tension correction signal applied to the tension limiter 50 exceeds a predetermined level so that the tension limiter 50 generates the reduction correction signal which is transmitted to the reduction unit 46 in the last stand $S_n$. The reduction unit 46 corrects the space between the upper and lower work rolls 4-n and 5-n so that the tension of the sheet metal 3 leaving the stand $S_n$ may be maintained below a predetermined tension level.

So far the upper work rolls have been described as operating the tension control rolls for controlling the tensions exerted to the sheet metal 3 between the stands, but it will be understood that the lower work rolls which are rotated faster than the upper work rolls may be so arranged as to act as the tension control rolls.

Furthermore as indicated by the two-dot chain lines the tension gages 28, 29 and 30 may be connected to the tension limiters 47, 48 and 49, respectively, so that in response to the excessive tensions detected by these gages the tension limiters 47, 48 and 49 may generate the reduction correction signals in a manner substantially similar to that described above.

It is understood that instead of the upper roll velocity regulation unit 13, a tension control unit similar in construction and operation to the tension control unit 36 in the second stand $S_2$ may be employed to control the peripheral velocity $V_0$ of the upper work roll 4-1 in the first stand $S_1$.

The effects, features and advantages of the rolling mills described in detail in conjunction will FIGS. 6 and 7 may be summarized as follows:

(I) Rolling may be effected under a low rolling pressure comparable to the rolling pressure in RD process, without the need of wrapping a sheet metal around work rolls.

(II) Without the need of wrapping a sheet metal around work rolls, continuous rolling may be carried out under the rolling conditions substantially similar to those of RD process.

(III) Since the wrapping of a sheet metal around work rolls is not needed, all of the problems and defects encountered when the sheet metal is wrapped around the work rolls may be completely eliminated.

(IV) The tension limiters are provided, each of which generates the reduction correction signal when the tension correction signal from the converter or the tension signal fed back from the tension gage exceeds a predetermined level, and in response to this reduction correction signal the reduction unit corrects the space between the upper and lower work rolls, whereby the correct, reliable and dependable tension control may be ensured.

What is claimed is:

1. A rolling mill of the type wherein a pair of upper and lower work rolls are rotated at such different peripheral velocities that the peripheral velocity ratio is substantially equal to an elongation ratio at which a sheet metal is rolled; which comprises (a) velocity detecting means for detecting the velocities of the sheet metal entering and leaving one or each rolling mill stand, (b) first work roll velocity control means for controlling the peripheral velocity of one of said pair of upper and lower work rolls which is rotated slower than the other, (c) second work roll velocity control means for controlling the peripheral velocity of the other work roll, (d) first velocity comparison means for comparing the peripheral velocity of said one work roll with the velocity of said sheet metal entering the or each rolling mill stand to generate tension correction signal representative of difference between the entering sheet metal velocity and the one work roll peripheral velocity when there exists a difference therebetween, and first sheet metal tension control means responsive to said tension correction signal for correcting the tension of the sheet metal entering the or each rolling mill stand, whereby the velocity of said sheet metal entering the or each rolling mill stand may be maintained substantially equal to the peripheral velocity of said one work roll, (e) second velocity compaison means for comparing the peripheral velocity of said the other work roll with the velocity of said sheet metal leaving the or each rolling mill stand to generate tension correction signal representative of difference between the leaving sheet metal velocity and the other work roll peripheral velocity when there exists a difference therebetween, and second sheet metal tension control means responsive to said second-mentioned tension correction signal for correcting the tension of the sheet metal leaving the or each rolling mill stand, whereby the velocity of said sheet metal leaving the or each rolling mill stand may be maintained substantially equal to the peripheral velocity of said the other work roll.

2. A rolling mill as set forth in claim 1 wherein said first and second velocity control means are work roll peripheral velocity regulators for maintaining predetermined peripheral velocities of said one and the other work rolls.

3. A rolling mill as set forth in claim 1 wherein each of said first and second velocity comparison means includes a tension gage for detecting the tension of said sheet metal entering or leaving the pair of work rolls and a limiter for the tension signal from the tension gage, said limiter generating reduction correction signal when the tension signal exceeds a predetermined level of said limiter, and a reduction unit is responsive to said reduction correction signal from said limiter for correcting the space between the pair of work rolls, whereby the velocities of said sheet metal entering and leaving the pair of work rolls may be maintained equal to the peripheral velocities of said one and said the other work rolls, respectively.

4. A rolling mill as set forth in claim 1 wherein each of said first and second velocity comparison means incudes a limiter for the tension correction signal, said limiter generating reduction correction signal when the tension correction signal exceeds a predetermined limit level of said limiter, and a reduction unit is responsive to said reduction correction signal from said limiter for correcting the space between the pair of work rolls, whereby the velocity of said metal sheet entering or leaving the pair of work rolls may be maintained equal to the peripheral velocity of said one or said the other work roll.

5. A rolling mill as set forth in claim 1 wherein metal sheet velocity detecting means is provided between adjacent two stands to detect the velocity of the sheet metal therebetween, a work roll velocity regulation unit is provided as the second work roll velocity control means for said the other work roll of the upstream-side stand in said adjacent stands and a work roll tension control unit is provided as the first work roll velocity control means for said one work roll of the downstream-side stand in the adjacent stands, said work roll tension control unit being responsive to the tension correction signal obtained by the comparison of the signal from said sheet metal velocity detecting means with the signal from said work roll velocity regulation unit representative of the peripheral velocity of the other work roll of the upstream-side stand when there exists a difference in velocity between the sheet metal between the adjacent stands and the other work roll in the upstream-side stand, whereby the velocity of said metal sheet leaving the upstream-side stand and entering the downstream-side stand may be maintained substantially equal to the peripheral velocity of the other work roll in the upstream-side stand and to the peripheral velocity of the one work roll in the downstream-side stand and thus at each rolling mill stand velocities of the sheet metal entering and leaving the stand may be maintained substantially equal to the peripheral velocities of one and the other work rolls, respectively.

* * * * *